US008915032B1

(12) United States Patent
Rivera et al.

(10) Patent No.: US 8,915,032 B1
(45) Date of Patent: Dec. 23, 2014

(54) FRAMELESS IMPACT WINDOW SYSTEM

(71) Applicants: Angelo Rivera, Oldsmar, FL (US); John Faour, Tampa, FL (US)

(72) Inventors: Angelo Rivera, Oldsmar, FL (US); John Faour, Tampa, FL (US)

( * ) Notice: Subject to any disclaimer, the term of this patent is extended or adjusted under 35 U.S.C. 154(b) by 0 days.

(21) Appl. No.: 13/866,646

(22) Filed: Apr. 19, 2013

Related U.S. Application Data

(60) Provisional application No. 61/642,878, filed on May 4, 2012.

(51) Int. Cl.

| | |
|---|---|
| ***E06B 7/00*** | (2006.01) |
| ***E06B 3/54*** | (2006.01) |
| ***E04H 9/14*** | (2006.01) |
| ***E06B 7/16*** | (2006.01) |

(52) U.S. Cl.
CPC ..... *E06B 3/5454* (2013.01); *E04H 9/14* (2013.01); *E06B 7/16* (2013.01)
USPC ..... 52/204.595; 52/204.1

(58) Field of Classification Search
USPC ..... 52/204.595, 202, 203, 204.1, 208, 52/204.55
See application file for complete search history.

(56) References Cited

U.S. PATENT DOCUMENTS

| | | | | | |
|---|---|---|---|---|---|
| 2,094,381 | A * | 9/1937 | Slayter | 52/786.13 |
| 2,602,970 | A * | 7/1952 | Gouge | 52/1 |
| 2,631,340 | A * | 3/1953 | Decker | 52/202 |
| 2,835,935 | A * | 5/1958 | Housley | 52/507 |
| 3,348,351 | A * | 10/1967 | Citarel et al. | 52/393 |
| 3,442,059 | A * | 5/1969 | Kessler | 52/204.595 |
| 4,015,394 | A * | 4/1977 | Kessler | 52/786.1 |
| 4,075,386 | A * | 2/1978 | Willdorf | 428/216 |
| 4,295,305 | A * | 10/1981 | Shelver | 52/172 |
| 4,514,945 | A * | 5/1985 | Menchetti et al. | 52/202 |
| 4,621,478 | A * | 11/1986 | Phillips et al. | 52/775 |
| 4,633,631 | A * | 1/1987 | Crandell | 52/235 |
| 5,361,476 | A * | 11/1994 | Leopold | 29/417 |
| 5,603,190 | A * | 2/1997 | Sanford | 52/202 |
| 5,678,377 | A * | 10/1997 | Leopold | 52/656.9 |
| 5,740,639 | A * | 4/1998 | Covington | 52/202 |
| 5,787,642 | A * | 8/1998 | Coyle et al. | 49/61 |
| 5,853,828 | A * | 12/1998 | Schimmelpenningh et al. | 428/34 |
| 5,918,430 | A * | 7/1999 | Rowland | 52/202 |
| 6,269,597 | B1 * | 8/2001 | Haas | 52/203 |
| 6,393,777 | B1 * | 5/2002 | Renfrow | 52/202 |
| 7,584,579 | B1 * | 9/2009 | Everitt | 52/202 |

* cited by examiner

*Primary Examiner* — Basil Katcheves
(74) *Attorney, Agent, or Firm* — Ronald E. Smith; Smith & Hopen, P.A.

(57) ABSTRACT

A window construction set in a pre-existing frame includes upper and lower horizontal channel members that respectively engage horizontal top and bottom edges of at least two window panes and first and second laterally spaced vertical channel members that respectively engage vertical outboard edges of the window panes. Each channel member is secured to a corresponding part of the frame and a structural shim is sandwiched between each channel member and its associated frame. The preferred embodiment includes multiple window panes disposed in lateral relation to one another so that all panes are secured at their top and bottom edges and two outboard window panes are further secured along their respective vertical outboard edges. Respective abutting inboard vertical edges of contiguous window panes are joined together by respective strips of silicone, there being no vertical frame members between abutting contiguous window panes.

6 Claims, 4 Drawing Sheets

FRAMELESS IMPACT WINDOW SYSTEM

BACKGROUND OF THE INVENTION

1. Field of the Invention

This invention relates, generally, to window construction. More particularly, it relates to a frameless window that meets hurricane and other impact standards.

2. Description of the Prior Art

Conventional glass systems that meet impact standards may include a transparent impact-resistant panel (also called pane) that is mounted in a pre-existing frame that engages the peripheral edges of the panel. When the pre-existing frame is wider than the width of a single panel, multiple panels are positioned in the frame in lateral relation to one another. Conventional frames are provided for each panel, engaging the peripheral edges of each panel, thereby creating an unsightly grid pattern that detracts from the aesthetic appeal of the windows. Such prior art frames call attention to themselves instead of the view outside the windows. The frames may be formed of steel or other suitable materials.

There is a need for window systems that meet impact standards but which are frameless where contiguous glass panels abut one another in a wide, multi-panel window. Such a window system would allow the view beyond the window to be fully appreciated without sacrificing the structural integrity of the window.

However, in view of the art considered as a whole at the time the present invention was made, it was not obvious to those of ordinary skill in the art how the needed frameless window system could be provided.

SUMMARY OF THE INVENTION

The long-standing but heretofore unfulfilled need for a window system that meets impact standards while obviating the need for prior art framing of each individual window panel on all four edges of the panel is now met by a new, useful, and non-obvious invention.

The inventive window construction is mounted to a horizontally disposed, pre-existing upper perimeter frame that provides a base for mounting a header structure that engages a top edge of at least one window pane, a horizontally disposed, lower perimeter frame that provides a base for mounting a footer structure that engages a bottom edge of said at least one window pane, a vertically disposed, pre-existing first side perimeter frame that provides a base for mounting a first jamb structure that engages a first lateral edge of said at least one window pane, and a vertically disposed, pre-existing second side perimeter frame that provides a base for mounting a second jamb structure that engages a second lateral edge of said at least one window pane.

All references to a frame in general or to particular parts of a frame such as an upper perimeter frame, lower perimeter frame, first side perimeter frame, and second side perimeter frame as used throughout this disclosure and claims refer to a window opening formed in a building structure as a part of the design of such building. Thus, the frame is not a separate structure but is an opening bordered by whatever material the builder uses to define the window opening, such as concrete, metal, block, or the like.

Although the inventive window construction can be used with only one window pane as recited above, its primary utility arises when used to secure at least two window panes that are laterally disposed relative to one another, with both window panes having their respective upper and lower peripheral edges engaged by the novel structure and where respective outboard, vertical peripheral edges of the at least two window panes are engaged by the novel structure. A strip of silicone or other suitable material is positioned between the two abutting window panes at their respective inboard vertical edges, and no further structural features are required to secure said windows against high impact forces.

The invention has even further utility when used in the context of more than two laterally disposed window panes, including a large number of laterally disposed window panes. Each window pane is respectively engaged at its upper and lower edges by the novel header and footer structure but only the two outboard windows are engaged along their respective outboard edges by the novel jamb structure. The vertical edges of the window panels disposed between the two outboard window panels are joined to their contiguous vertical edges by a vertical silicone strip.

In a preferred embodiment, the header structure includes a horizontally-disposed, downwardly-opening U-shaped channel having a lateral extent equal to the lateral extent of at least two window panes. However, the scope of this invention also includes the novel structure when used with only one window pane.

The preferred footer structure includes a horizontally-disposed, upwardly-opening U-shaped channel having a lateral extent equal to the lateral extent of at least two window panes.

The first jamb structure includes a first vertically-disposed U-shaped channel that extends from the downwardly-opening U-shaped channel to the upwardly-opening U-shaped channel at a first lateral, outboard end of a first window pane. The first vertically-disposed U-shaped channel opens in an inboard direction, i.e., away from the first jamb.

The second jamb structure includes a second vertically disposed U-shaped channel that extends from the downwardly-opening U-shaped channel to the upwardly-opening U-shaped channel at a second lateral, outboard end of a second window pane. The second vertically-disposed U-shaped channel opens in an inboard direction, i.e., away from the second jamb, i.e., the respective vertically disposed U-shaped channels open towards one another.

A first structural shim is positioned between a top wall of the horizontally-disposed, downwardly-opening U-shaped channel and a bottom wall of the upper perimeter frame. A second structural shim is positioned between a bottom wall of the horizontally-disposed, upwardly-opening U-shaped channel and a top wall of the lower perimeter frame. A third structural shim is positioned between a bottom wall of the vertically-disposed U-shaped channel of the first jamb structure and the first side perimeter frame, and a fourth structural shim is positioned between a bottom wall of the vertically disposed U-shaped channel of the second jamb structure and the second side perimeter frame.

The downwardly-opening U-shaped channel is secured by suitable means to the bottom wall of the upper perimeter frame with the first structural shim member sandwiched between the downwardly-opening channel and the upper perimeter frame. The upwardly-opening U-shaped channel is secured by suitable means to the top wall of the lower perimeter frame with the second structural shim member sandwiched between the upwardly-opening channel and the lower perimeter frame.

The first vertically disposed U-shaped channel is secured by suitable means to the first vertically disposed side perimeter frame with the third structural shim member sandwiched between the first vertically disposed U-shaped channel and the second vertically disposed side perimeter frame. The second vertically disposed U-shaped channel is secured by suitable means to the second vertically disposed side perimeter frame with the fourth structural shim member sandwiched between the second vertically disposed U-shaped channel and the second vertically disposed side perimeter frame.

A first strip of silicone is disposed along the respective exterior lateral extents of the first, second, third and fourth structural shims and a second strip of silicone is disposed along the respective interior lateral extents of the first, second, third and fourth structural shims.

A first strip of silicone is also disposed between an exterior wall of the horizontally-disposed, downwardly opening channel and an upper exterior edge of the at least two window panes and a second strip of silicone is disposed between an interior wall of the horizontally-disposed, downwardly opening channel an upper interior edge of the at least two window panes.

Similarly, a first strip of silicone is disposed between an exterior wall of the horizontally-disposed, upwardly opening channel and a lower exterior edge of the at least two window panes and a second strip of silicone is disposed between an interior wall of the horizontally-disposed, upwardly opening channel and a lower interior edge of the at least two window panes.

A first strip of silicone is also disposed between an exterior wall of the first vertically-disposed, inwardly opening channel and an exterior surface of the first vertically disposed lateral edge of the at least two window panes and a second strip of silicone is disposed between an interior wall of the first vertically-disposed, inwardly opening channel and an interior surface of the first vertically disposed lateral edge of the at least two window panes.

A first strip of silicone is disposed as well between an exterior wall of the second vertically-disposed, inwardly opening channel and an exterior surface of the second vertically disposed lateral edge of the at least two window panes and a second strip of silicone is disposed between an interior wall of the second vertically-disposed, inwardly opening channel and an interior surface of the second vertically disposed lateral edge of the at least two window panes.

Where respective edges of at least two window panes are secured by said channel members, a strip of silicone is disposed between contiguous vertical free edges of said window panes, there being no need for one or more unsightly prior art frames to join said contiguous edges.

A pair, or a larger number of window panes, are interconnected to one another along their respective contiguous vertical free edges by respective strips of silicone. Contiguous panes may be disposed in a common plane or contiguous panes may be disposed at an angle relative to one another that is between approximately one hundred thirty five degrees and one hundred eighty degrees (135°-180°).

An important object of this invention is to provide a window system that meets impact standards but which does not require frames that are mounted around the peripheral edges of individual window panes.

A more specific object is to provide such a system where one or more glass panes may be engaged by a frame structure at their upper and lower edges only.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
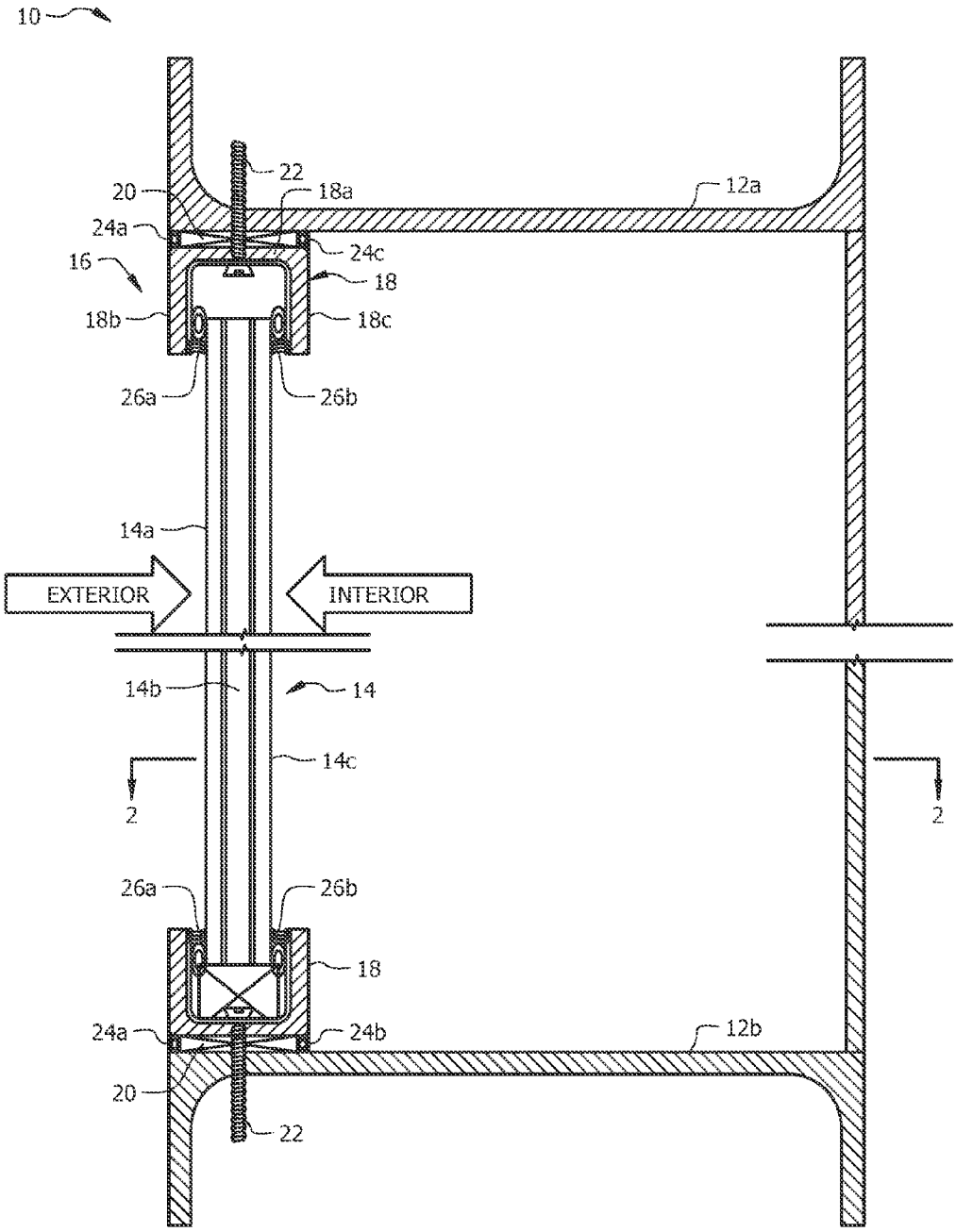
FIG. 1 is a vertical sectional view of the novel structure.
Figure 2:
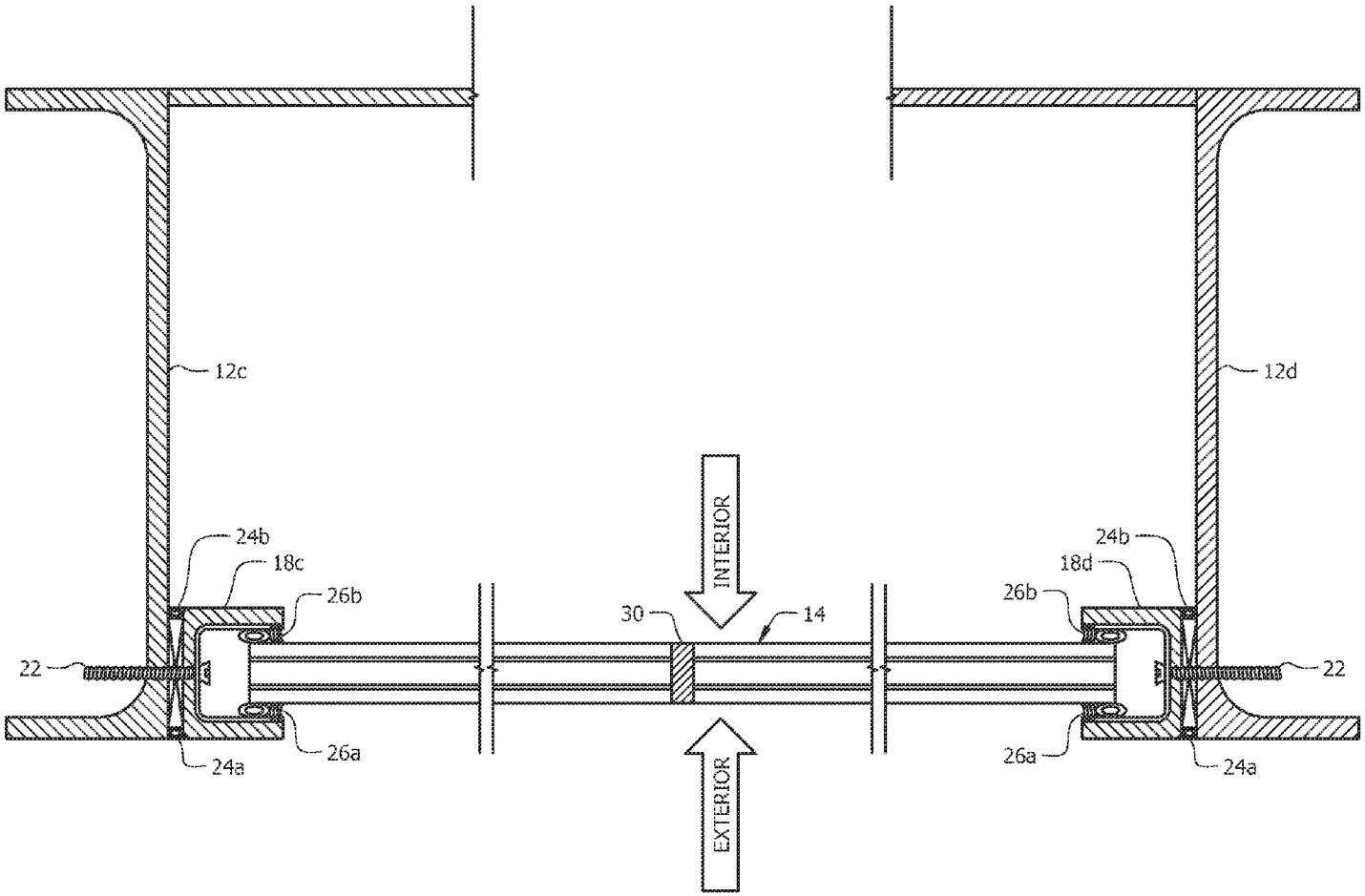
FIG. 2 is a horizontal sectional view of the novel structure, taken along line 2-2 in FIG. 1, depicting two (2) window panes disposed at a one hundred eighty degree (180°) angle with respect to one another.

FIGS. 1 and 2 depict an illustrative embodiment of the novel structure which is denoted as a whole by the reference numeral 10.

The novel window system is positioned between pre-existing upper perimeter frame 12*a* which is horizontally disposed and which provides a base for the mounting of the novel header structure and lower perimeter frame 12*b* which is also horizontally disposed and provides a base for the mounting of the novel footer structure. Frames 12*a* and 12*b* are window openings formed in a building structure as mentioned above.

The novel window pane is denoted 14. It is preferably provided in three laminations: exterior pane 14*a* has a preferable thickness of a quarter inch (¼"), middle pane 14*b* has a preferable thickness of three-eighths of an inch (⅜"), as does interior pane 14*c*. All three (3) panes are preferably clear heat strengthened. DUPONT® 0.090 S.G. glass performs well. However, this invention is not limited to any particular number of laminations of glass panes, or to any particular thickness of each lamination, or to any particular treatment of glass panes because it works with any suitable impact-resistant glass, not just the preferred glass.

Header structure 16 includes U-shaped aluminum channel 18 having a lateral extent equal to the lateral extent of window 14. Header channel 18 opens downwardly as depicted in FIG. 1.

Structural shim 20 is positioned between top wall 18*a* of channel 18 and the bottom wall of upper perimeter frame 12*a*. A plurality of equidistantly spaced apart screws 22, preferably of the self-drilling type, secure channel 18 to said upper perimeter frame 12*a*. Each screw 22 is preferably centered between exterior and interior walls 18*b*, 18*c* of said channel 18.

A strip of black silicone 24*a* is applied along the exterior lateral extent of shim 20 and a strip of black silicone 24*b* is applied along the interior lateral extent of shim 20. The preferred black silicone is DOW CORNING® black silicone with a three-eighths of an inch (⅜") backer rod.

A strip of black silicone 26*a* is applied between exterior wall 18*b* of channel 18 and the upper exterior edge of window 14 and a strip of black silicone 26*b* is applied between interior wall 18*c* of channel 18 and the upper interior edge of window 14. The preferred black silicone is DOW CORNING® black silicone with a one-half inch (½") backer rod.

The same structure is employed at the sill or footer of the window, with channel 18 of course opening upwardly at this end of the structure. The same reference numerals are therefore applied to the respective parts as in the disclosure of the header end of the window.

Referring now to FIG. 2, it will there be understood that pre-existing vertically disposed side perimeter frame 12*c* defines the left end of the window structure as drawn and pre-existing vertically disposed side perimeter frame 12*d* defines the right end of the window structure as drawn. This view is taken long line 2-2 in FIG. 1 as aforesaid so it is understood that perimeter frames 12*c* and 12*d* are laterally spaced apart from one another. Said frames 12*c* and 12*d*, like frames 12*a* and 12*b*, are window openings formed in a building.

If perimeter side frames 12*c* and 12*d* are spaced apart from one another by the lateral extent of a single window pane, then the left edge of that window pane is secured as depicted at the lower left end of FIG. 2 and the right edge of that window pane is secured as depicted at the lower right end of FIG. 2. The reference numerals are consistent with the reference numerals employed in connection with FIG. 1 so that the disclosure need not be repeated. The aluminum channels are denoted 18*c* and 18*d* because they are vertically disposed and open toward one another to engage the respective lateral edges of the window pane. Vertical channels 18*c* and 18*d* are positioned between the opposite ends of horizontal channels 18*a* and 18*b*, i.e., channels 18*a-d* collectively form a square or rectangular frame.

If two or more window panes are mounted between perimeter frames 12*c* and 12*d*, a strip of black silicone 30, depicted in FIG. 2, is applied between contiguous vertical edges of said window panes. DOW CORNING® black silicone is the preferred silicone. Due to the robust nature of the novel frame, no further seal between contiguous window panes is needed, thereby eliminating the unsightly frames of the prior art. FIG. 2 is a top plan view depicting two window panes disposed at a one hundred eighty degree (180°) angle with respect to one another.

A large number of window panes may be connected to one another in this way, providing an expansive and uncluttered view therethrough.

Figure 3A:
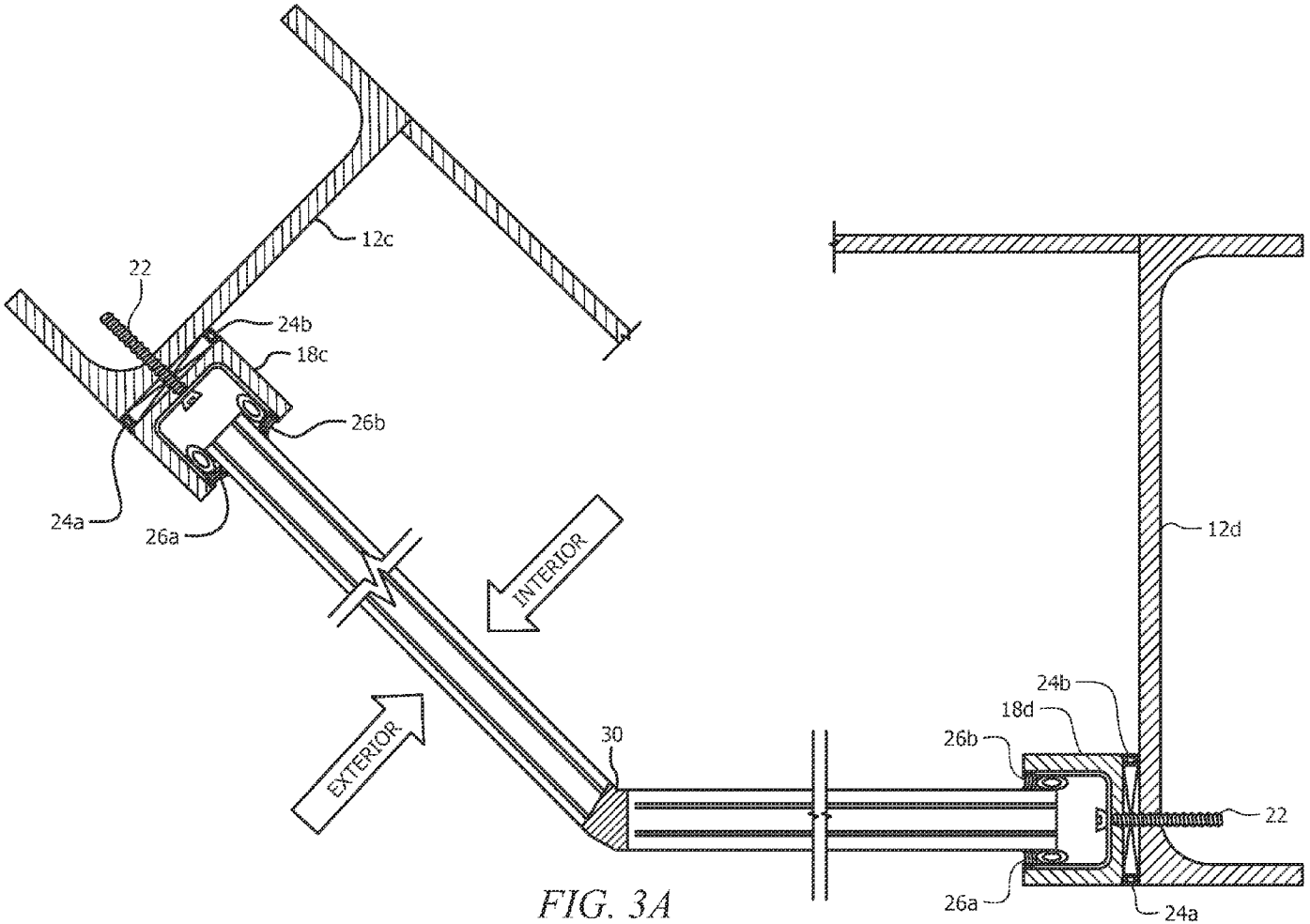
FIG. 3A is a top plan view depicting two window panes disposed at a one hundred thirty five degree (135°) angle with respect to one another.

The window panes may collectively form a flat surface but contiguous panes may also be angled with respect to one another at an angle of one hundred thirty five degrees (135°) or more. FIG. 3A is a top plan view depicting two window panes disposed at a one hundred thirty five degree (135°) angle with respect to one another.

Figure 3B:
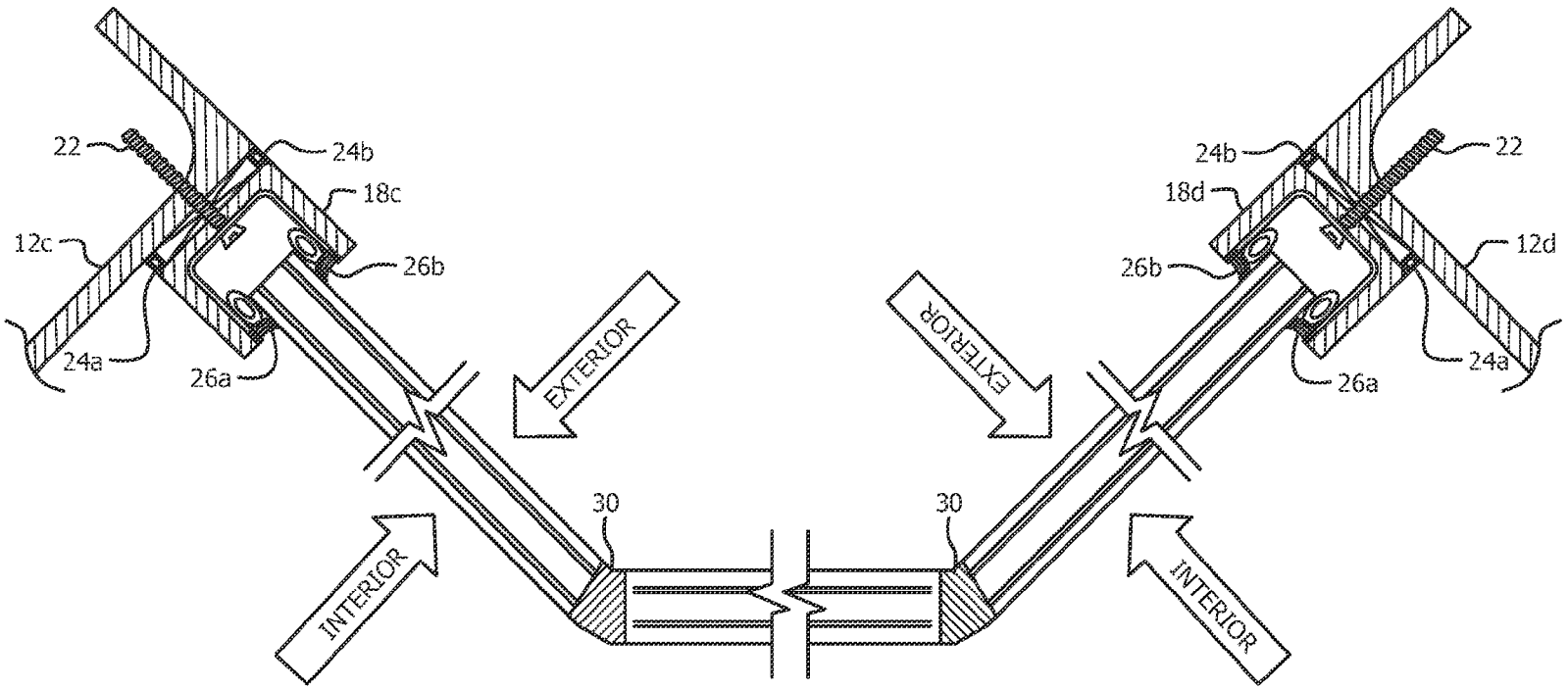
FIG. 3B is a top plan view depicting three window panes where a first and second window pane are disposed at a one hundred thirty five degree (135°) angle with respect to one another and where said second window pane and a third window pane are disposed at a one hundred thirty five degree (135°) angle with respect to one another.

FIG. 3B is a top plan view depicting three window panes where a first and second window pane are disposed at a one hundred thirty five degree (135°) angle with respect to one another and where said second window pane and a third window pane are disposed at a one hundred thirty five degree (135°) angle with respect to one another.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A window construction, comprising:

a header structure that engages a top edge of at least two window panes disposed in lateral, edge-abutting relation to one another, said header structure adapted for mounting to a horizontally disposed, upper perimeter frame;

a footer structure that engages a bottom edge of said at least two window panes, said footer structure adapted for mounting to a horizontally disposed, lower perimeter frame;

a first jamb structure that engages an outboard end of a first window pane of said two window panes, said first jamb structure adapted for mounting to a vertically disposed, first side perimeter frame;

a second jamb structure that engages an outboard end of a second window pane of said two window panes, said second jamb structure adapted for mounting to a vertically disposed, second side perimeter frame;

said header structure including a horizontally-disposed, downwardly-opening U-shaped channel having a lateral extent substantially equal to a combined lateral extent of said at least two window panes;

said footer structure including a horizontally-disposed, upwardly-opening U-shaped channel having a lateral extent substantially equal to the lateral extent of said two window panes;

said first jamb structure including a first vertically-disposed U-shaped channel that extends from said downwardly-opening U-shaped channel to said upwardly-opening U-shaped channel at an outboard end of said first window pane;

said second jamb structure including a second vertically disposed U-shaped channel that extends from said downwardly-opening U-shaped channel to said upwardly-opening U-shaped channel at an outboard end of said second window pane;

said respective U-shaped channels of said first and second jamb structures opening towards one another;

a strip of silicone disposed between contiguous vertical free edges of said at least two laterally disposed, edge-abutting window panes;

said single frame holding at least two laterally disposed, edge abutting window panes;

each of said window panes formed of three laminations;

said three laminations including an exterior pane having a thickness of about a quarter inch (¼"), a middle pane having a thickness of about three-eighths of an inch (⅜"), and an interior pane having a thickness of about three-eighths of an inch (⅜");

there being no frame where said two laterally disposed, edge-abutting window panes abut one another.

2. The window construction of claim 1, further comprising:

a first structural shim positioned between a top wall of said horizontally-disposed, downwardly-opening U-shaped channel and a bottom wall of said upper perimeter frame;

a second structural shim positioned between a bottom wall of said horizontally-disposed, upwardly-opening U-shaped channel and a top wall of said lower perimeter frame;

a third structural shim positioned between a bottom wall of said vertically-disposed U-shaped channel of said first jamb structure and said first side perimeter frame;

a fourth structural shim positioned between a bottom wall of said vertically disposed U-shaped channel of said second jamb structure and said second side perimeter frame;

said downwardly-opening U-shaped channel secured to said bottom wall of said upper perimeter frame with said first structural shim member being sandwiched between said downwardly-opening channel and said upper perimeter frame;

said upwardly-opening U-shaped channel secured to said top wall of said lower perimeter frame with said second structural shim member being sandwiched between said upwardly-opening channel and said lower perimeter frame;

said first vertically disposed U-shaped channel secured to said first vertically disposed side perimeter frame with said third structural shim member being sandwiched between said first vertically disposed U-shaped channel and said second vertically disposed side perimeter frame;

said second vertically disposed U-shaped channel secured to said second vertically disposed perimeter frame with said fourth structural shim member being sandwiched between said second vertically disposed U-shaped channel and said second vertically disposed side perimeter frame.

3. The window construction of claim 2, further comprising:

a first strip of silicone disposed along an exterior lateral extent of said first structural shim and a second strip of silicone disposed along an interior lateral extent of said first structural shim;

a first strip of silicone disposed along an exterior lateral extent of said second structural shim and a second strip of silicone disposed along an interior lateral extent of said second structural shim;

a first strip of silicone disposed along an exterior lateral extent of said third structural shim and a second strip of silicone disposed along an interior lateral extent of said third structural shim; and a first strip of silicone disposed along an exterior lateral extent of said fourth structural shim and a second strip of silicone disposed along an interior lateral extent of said fourth structural shim.

4. The window structure of claim 1, further comprising:

said first and second window panes being disposed in a common plane.

5. The window structure of claim 1, further comprising:

said first and second window panes being disposed at an angle relative to one another that is between approximately one hundred thirty five degrees and one hundred eighty degrees (135°-180°).

6. The window structure of claim 1, further comprising:

a strip of silicone disposed between an exterior wall of said horizontally-disposed, downwardly opening channel and respective upper exterior edges of said at least two window panes and a strip of silicone disposed between an interior wall of said horizontally-disposed, downwardly opening channel and respective upper interior edges of said at least two window panes;

a strip of silicone disposed between an exterior wall of said horizontally-disposed, upwardly opening channel and respective lower exterior edges of said at least two window panes and a strip of silicone disposed between an interior wall of said horizontally-disposed, upwardly opening channel and respective lower interior edges of said at least two window panes;

a strip of silicone disposed between an exterior wall of said first vertically-disposed, inwardly opening channel and an exterior surface of said first vertically disposed outboard edge of a first window pane and a strip of silicone disposed between an interior wall of said first vertically-disposed, inwardly opening channel and an interior surface of said first vertically disposed outboard edge of said first window pane;

a first strip of silicone disposed between an exterior wall of said second vertically-disposed, inwardly opening channel and an exterior surface of said second vertically disposed outboard edge of a second window pane and a strip of silicone disposed between an interior wall of said second vertically-disposed, inwardly opening channel and an interior surface of said second vertically disposed outboard edge of said second window pane.

* * * * *